US006184502B1

(12) United States Patent
Haazendonk

(10) Patent No.: US 6,184,502 B1
(45) Date of Patent: Feb. 6, 2001

(54) HEATER, PARTICULARLY FOR KITCHEN APPLIANCES

(75) Inventor: Joachim Haazendonk, Oberderdingen (DE)

(73) Assignee: E.G.O. Elektro-Geratebau GmbH (DE)

( * ) Notice: Under 35 U.S.C. 154(b), the term of this patent shall be extended for 0 days.

(21) Appl. No.: 09/209,590

(22) Filed: Dec. 11, 1998

(30) Foreign Application Priority Data

Dec. 11, 1997 (DE) ..... 197 55 114

(51) Int. Cl.[7] ..... H05B 3/68

(52) U.S. Cl. ..... 219/460.1; 219/461.1; 338/283

(58) Field of Search ..... 219/443.1, 448.19, 219/449.1, 451.1, 452.11, 452.12, 460.1, 461.1, 462.1, 520, 521, 536, 537, 540, 542; 338/283, 284, 285, 286

(56) References Cited

U.S. PATENT DOCUMENTS

| | | | | |
|---|---|---|---|---|
| 1,970,075 | * | 8/1934 | Buckland | 219/460.1 |
| 3,612,828 | | 10/1971 | Siegla . | |
| 3,991,298 | | 11/1976 | Maake . | |
| 4,207,672 | * | 6/1980 | Wohlert | 219/542 |
| 4,243,874 | * | 1/1981 | Fischer | 219/461.1 |
| 4,713,527 | * | 12/1987 | Kicherer et al. | 219/461.1 |
| 5,393,958 | * | 2/1995 | Gross et al. | 219/461.1 |
| 5,453,597 | * | 9/1995 | McWilliams | 219/461.1 |
| 5,512,731 | * | 4/1996 | McWilliams | 219/461.1 |
| 5,796,075 | * | 8/1998 | Gross et al. | 219/461.1 |

FOREIGN PATENT DOCUMENTS

| | | |
|---|---|---|
| 25 51 137 | 5/1977 | (DE) . |
| 27 29 930 | 1/1979 | (DE) . |
| 28 20 114 | 11/1979 | (DE) . |
| 41 37 251 | 5/1993 | (DE) . |
| 195 22 798 | 1/1997 | (DE) . |
| 196 10 874 | 9/1997 | (DE) . |
| 0 590 315 | 4/1994 | (EP) . |
| 0 612 195 | 8/1997 | (EP) . |
| WO 97/20451 | 6/1997 | (WO) . |

* cited by examiner

*Primary Examiner*—Teresa Walberg
*Assistant Examiner*—Fadi H. Dahbour
(74) *Attorney, Agent, or Firm*—Akerman Senterfitt

(57) ABSTRACT

A heater (1) particularly usable as a radiant heater for electric cookers is described, which has a insulating substrate (2) of microporous thermal insulation material and at least one electric heating conductor (20) in the form of an upright, corrugated flat strip fixed to the top of the insulating substrate. The top side of the insulating substrate is structured in honeycomb-like manner and has a network of raised portions (10) between which are located roughly cylindrical depressions (11). With small-surface fixing portions the heating conductor positively engages in the raised portions (10) and is held in freely suspended manner over the insulating substrate in the vicinity of the depressions (11).

29 Claims, 3 Drawing Sheets

HEATER, PARTICULARLY FOR KITCHEN APPLIANCES

Figure 1:
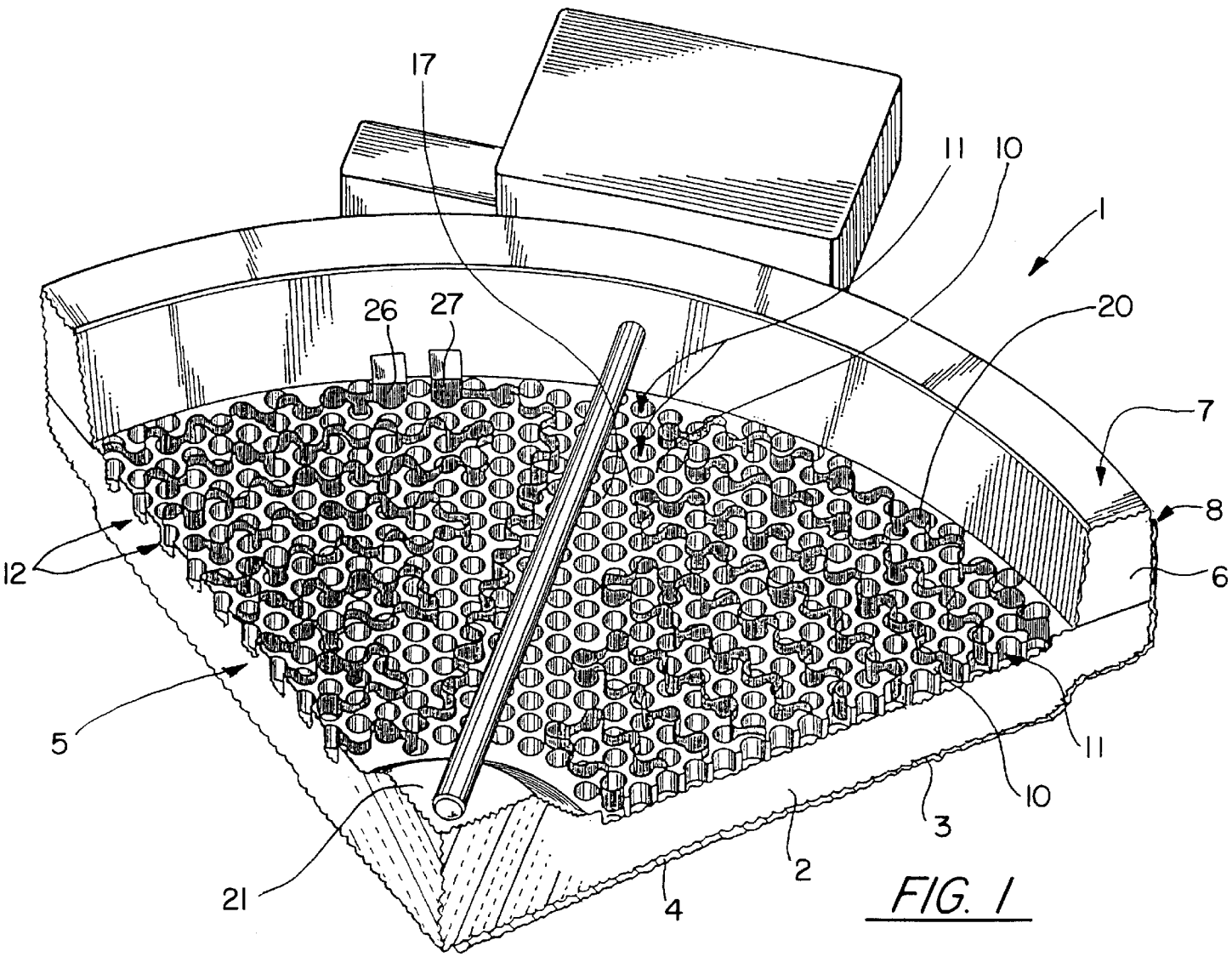

The invention relates to a heater, particularly for kitchen appliances.

Such heaters can in particular be used for the heating of a hotplate. They are preferably constructed in radiant heater form and usually constitute a closed assembly, which can be fixed as such to a corresponding appliance, e.g. in a hob of an electric cooker. Such heaters have a single or multipart insulating substrate and at least one electric heating conductor fixed to the top of the insulating substrate. The insulating substrate material is appropriately at least electrically insulating, but preferably also thermally insulating, so that thermal energy is only eliminated to a limited extent towards the rear of the insulating substrate. The heating conductor can e.g. be in the form of an at least zonally straight and/or helical heating conductor wire. Particularly in the case of radiant heaters, a heating conductor can also be in flat strip form and optionally longitudinally corrugated. The assembly constituted by the insulating substrate and heating conductor appropriately has a through, normally roughly planar surface extension and, in operation, it can give off and in particular emit thermal energy substantially over the entire surface area provided with heating conductors.

The insulating substrate of such heaters is provided on its top side with a profiling having raised portions and depressions or cavities. Known heaters of this type can be subdivided into two classes. In one class the depressions are slot-like and are used for fixing the position of a heating conductor to be inserted into the slot. The heater according to U.S. Pat. No. 3,991,298 has an insulating substrate with a planar surface, in which is made a spiral slot. A heating conductor in the form of a smooth flat strip is upright in the slot and projects out of the slot over most of its height. The heater according to U.S. Pat. No. 3,612,828 also has a substantially planar insulating substrate with a spiral, relatively wide slot, in which is inserted a longitudinally corrugated flat strip heating conductor. The depth of the slot corresponds to the height of the heating conductor, so that the latter is flush with the top sides of the raised portions between the slots. In both cases the heating conductors are secured against lifting out of the slot by separate fastening elements. A similar construction occurs in the case of the heater disclosed by European patent 612 195, in which arcuate slots receive a heating conductor in the form of an upright, longitudinally corrugated flat strip, in order to fix the position of the heating conductor on the insulating substrate. In the longitudinal direction of the slot are arranged therein spaced crosswebs or crossbars made from the material of the insulating substrate and in which the heating conductor engages. The crosswebs serve to fix the heating conductor to the insulating substrate.

In the second class of heaters with profiled insulating substrate, the raised portions are in the form of straight webs, which project over a planar surface of the insulating substrate and which serve to support and fasten the heating conductors zonally embedded therein. As an example, German patent 27 29 930 discloses a heater having a circular insulating substrate and helical heating conductors installed spirally around the centre. The webs of the insulating substrate have a radial orientation, so that the heating conductor must pass over the same substantially perpendicular to the web. The rectangular heater of German patent 28 20 114 has longitudinally parallel, helical heating conductors, which are carried by uniformly spaced crosswebs of the insulating support and are zonally embedded in the latter. Here again the path of the webs is adapted to that of the heating conductor in such a way that the webs run substantially perpendicular to the longitudinal direction of the heating conductor.

The problem of the invention is to so further develop a heater according to the preamble, that it can be particularly easily manufactured.

To solve this problem the invention proposes a heater having the features of claim 1.

A heater according to the invention is characterized in that raised portions and depressions are distributed over the top side of the insulating support in the manner of a network and that the heating conductor engages in the raised portions. The term "network" here means a surface distribution of substantially longitudinally extending structures running in different directions along the top side and which preferably meet at junctions or intersections. The junctions or intersections also have a predetermined surface distribution.

A network-like distribution of raised portions and depressions over the top side of the insulating support offers a heating conductor to be fixed to the top side fixing points or locations arranged in specific intervals predeterminable by the dimensioning of the network in the vicinity of the raised portions and in which the heating conductor can engage. Network-like, raised portions running in criss-cross manner over the top side or raised portions between network-like slots on the top side offer the heating conductor a plurality of engagement or retaining points substantially independently of the way in which the heating conductor runs on the surface. It can therefore be possible to use an insulating substrate with a specific, network-like, honeycomb or studded structuring of its surface for carrying differently designed and/or constructed heating conductors, because the profiling of the surface need not necessarily be oriented with respect to the desired manner of the installation of the heating conductor. An inventively constructed insulating substrate can be used as a universal insulating substrate, thereby facilitating the manufacture of heaters.

Although the surface distribution of intersections and longitudinally extending structures can be irregular, it is preferably uniform, so that identical configurations of raised portions and depressions are regularly repeated in different directions in the insulating substrate surface. The network can be formed by channels or slots, between which raised portions remain. As a result, e.g. surfaces with a studded structure can be created and the studs can have e.g. a truncated cone-shaped or spherical configuration. In other constructions, the network gaps are formed by depressions or cavities, so that the raised portions form the network. As a result of the meeting at the intersections, the raised portions stabilize one another.

The invention makes it possible to construct the insulating substrate by appropriate network-like, honeycomb or studded structuring of its top side for punctiform, positive fixing and securing of the heating conductor engaging in the raised portions so as to prevent a lifting out from the insulating substrate. The density of the fixing points is determined by the "mesh size" of the network and the path of the heating conductor relative thereto. There is no need to construct on the actual heating conductor fixing members for positive engagement in the insulating substrate, as is e.g. the case with the heating conductors of DE 25 51 137 or EP 590 315. The flat strip-like heating conductors according thereto have fixing feet, which are longitudinally spaced and constructed in one piece with the heating conductor and which can be manufactured by a punching process and which are provided for engaging in an insulating substrate with a planar surface. Such fixing elements on the heating conductor can be avoided in the case of an insulating substrate structured according to the invention. The invention makes it possible for the heating conductor to have a substantially constant cross-section along its length. Such heating conductors can be particularly easily manufactured, have a uniform, resistance-active cross-section along their length and consequently, when a voltage is applied, heat very uniformly along their length.

A heating conductor can e.g. be circular in cross-section, but according to a preferred embodiment is in the form of a preferably corrugated flat strip, which has parallel wide sides and preferably non-offset, through, parallel narrow sides. The wide sides are preferably inclined and are in particular substantially perpendicular to a preferably planar surface defined by the lateral extension of the insulating substrate. Flat resistors, whose resistance-active cross-sections are at least in part not parallel to the heating plane defined by the insulating substrate, but are instead inclined up to a right angle thereto, are inter alia advantageous because even in the case of a high resistance power transversely to their longitudinal extension and roughly parallel to the heating plane they require less space and can therefore be arranged with a higher power density and can be better insulated against leakage currents.

Particular preference is given to foil-like, thin heating conductors, whose thickness is preferably between 0.02 and 0.1 mm, particularly between 0.04 and 0.08 mm, particularly approximately 0.05 mm. The width, or in the case of an upright flat strip, the height, can e.g. be between 1 and 5 mm, e.g. approximately 3 mm. Such thin, flat heating conductors heat rapidly in advantageous manner, e.g. within less than 10 or 8 or 5 seconds, to their operating temperature, which is in particular above 1200 or 1300 K and below 1600 K. The ratio of the mass of such low-mass heating conductors to their rated power can be less than $7\times10^{-3}$ gram per watt [g/W], which significantly shortens the glow-up time compared with more solid heating conductors. A suitable material for the heating conductors is in particular Fe-Cr-Al alloy, which has an aluminium proportion of more than 4%, preferably approximately 5%.

In the vicinity of the depressions, it is possible for a heating conductor to engage slightly in the insulating substrate material. A preferred embodiment is characterized in that the heating conductor engages solely in the raised portions, so that in the vicinity of the depressions the heating conductor does not penetrate the insulating substrate material.

It has proved particularly advantageous if, in the vicinity of at least one depression and preferably in that of all the depressions, there is an internal spacing between a bottom of the depression and the heating conductor. A heating conductor held in this way is suspended in the area between the raised portions above the insulating substrate. It is particularly easy to compensate differences in the thermal expansions of heating conductor and insulating substrate in this area, in that on heating the heating conductor expands in the freely suspended area and correspondingly forms a curvature or increases an existing curvature. A freely suspended heating conductor portion is also particularly advantageous with respect to the attainable heat radiation.

The raised portions can at least zonally have cross-sections, which e.g. taper in triangular or U-shaped manner to the radiation or emission side. In a preferred embodiment the depressions are substantially defined by lateral faces running roughly perpendicular to a preferably planar surface of the insulating substrate. Thus, the raised portions are present in the form of webs or ribs with approximately perpendicular side walls. Depressions or raised portions with approximately perpendicular, lateral boundary surfaces are particularly easy to manufacture, e.g. by moulding in corresponding moulds or in that the depressions are made in an insulating substrate by embossing or drilling. It can be advantageous if a depression widens slightly towards the heating conductor. The raised portions between such depressions can consequently be roughly trapezoidal in cross-section. Depressions with lateral faces, which are e.g. oriented at between 5 and 35° inclined to the perpendicular of the insulating substrate, can be readily produced by embossing the not yet completely hardened insulating substrate material. A shaping or embossing die can be particularly easily removed from the embossed insulating substrate with widening depressions.

The depressions can have a cross-section with an irregular shape arranged parallel to the preferably planar surface of the insulating substrate. However, preferably one or all the depressions have a centrosymmetrical cross-section, which e.g. has a three, four or six-fold rotational symmetry, e.g. in the manner of a honeycomb. The depressions can be free from angles, so that any angles or corners present can e.g. be rounded. In a preferred embodiment the depressions have a circular cross-section and in particular have a substantially identical cross-sectional surface. It is also possible to provide complimentary structures with correspondingly shaped, raised portions. The latter can then be e.g. in the form of studs, which can in particular have a truncated cone-shaped or spherical configuration.

Although the surface distribution of the depressions or protuberances in the insulating substrate can be regular, according to a further development of the invention it is possible to have a uniform, particularly a three, four or six-fold symmetrical surface distribution of depressions or raised portions, which are preferably similarly dimensioned and are substantially identical to one another. Such a honeycomb-like or cell-like structuring of the surface, over which extends a regular network of raised portions, or such a studded structure is easy to manufacture and has roughly identical characteristics over the entire area of the insulating substrate, particularly with respect to mechanical loadability and the emission or radiation behaviour for heating energy.

The depressions can take up a relatively large surface proportion of the entire insulating substrate, e.g. between 40 and 90%, particularly approximately 50% of the surface. A lateral spacing of the heavy points or centroids, particularly the centres of adjacent depressions can e.g. be between 1.1 and 2 times, preferably approximately 1.3 times as large as the largest diameter of a depression, so that relatively narrow, raised portions are formed between the depressions. This makes it possible to provide a large part of the heating conductor length in the area of the depressions, which positively influences the electrical efficiency of the heater. The depth of the depressions, measured from a preferably roughly planar top side of a raised portion to a preferably planar bottom of a depression can be of the order of magnitude of the height of the heating conductor. Preferably the ratio between the depth of a depression and an average height of a heating conductor is between 0.2 and 3, particularly approximately 1. Preferably the depth of depressions is less than the depth of an insulating substrate insulator having the depressions. Thus, below the depressions there is still insulating material, which is on the one hand thermally insulated and on the other contributes to the mechanical stabilization of the insulating substrate body having the depressions.

For example, the average depth of the depressions can be between ⅛ and ¾ of the insulating substrate thickness and is in particular roughly ¼. It is also possible for the depressions to be formed by through holes of a first part of the insulating substrate, which lies in particular flat and without gaps on a preferably planar top side of a second part of the insulating substrate. The insulating substrate can be built up in sandwich-like manner, the upper part being constructed in the manner of a perforated plate. The different parts of the insulating substrate can be made from the same or from different materials.

Although it is preferable for the heating conductor to project over the top side of the raised portions, preferably by between 10 and 80%, particularly approximately 50% of its height, particularly in the case of heating conductors for higher rated voltages they can be made very narrow. Over its entire height the heating conductor can engage in the raised portions to such an extent that its top side or edge terminates substantially flush with the top side of the raised portions or is even positioned below the same. Thus, even in the area of the raised portions holding the heating conductor it is possible to attain an adequate emission capacity of the heating conductor, which aids a roughly uniform heat emission of the heater varying only slightly over the entire heating plane.

These and further features can be gathered from the claims, description and drawings and the individual features, either singly or in the form of subcombinations, can be implemented in an embodiment of the invention or in other fields and can represent advantageous constructions. The invention is described in greater detail hereinafter relative to an embodiment and the attached drawings, wherein show:

FIG. 1 A perspective, sloping plan view of a sector of a preferred embodiment of an inventively constructed heater.

Figure 2:
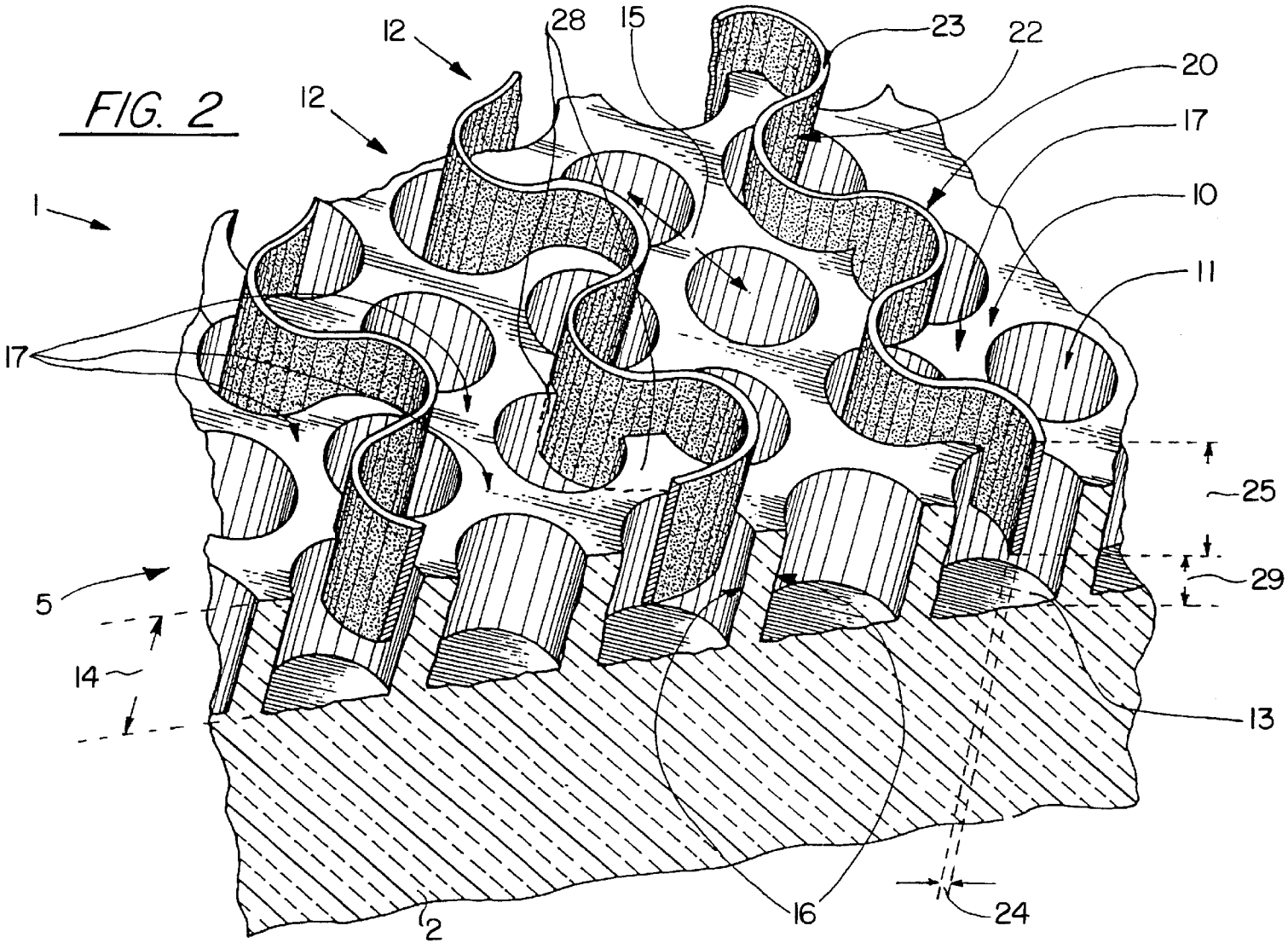

FIG. 2 A larger scale detail of the embodiment of FIG. 1.

Figure 3:
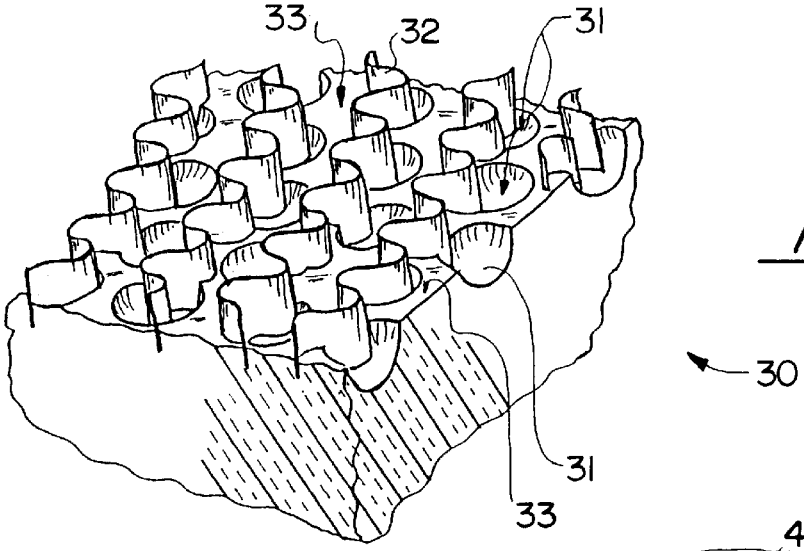

FIG. 3 An embodiment with an insulator, in which a network of raised portions is located between the hemispherical depressions.

Figure 4:
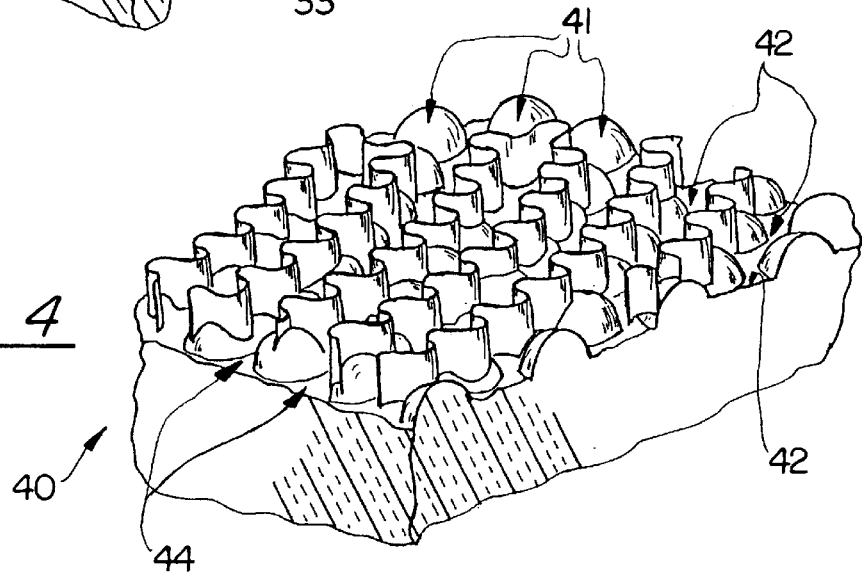

FIG. 4 An embodiment with a surface structure, complimentary to FIG. 3, with spherical studs, between which is provided a network of depressions.

Figure 5:
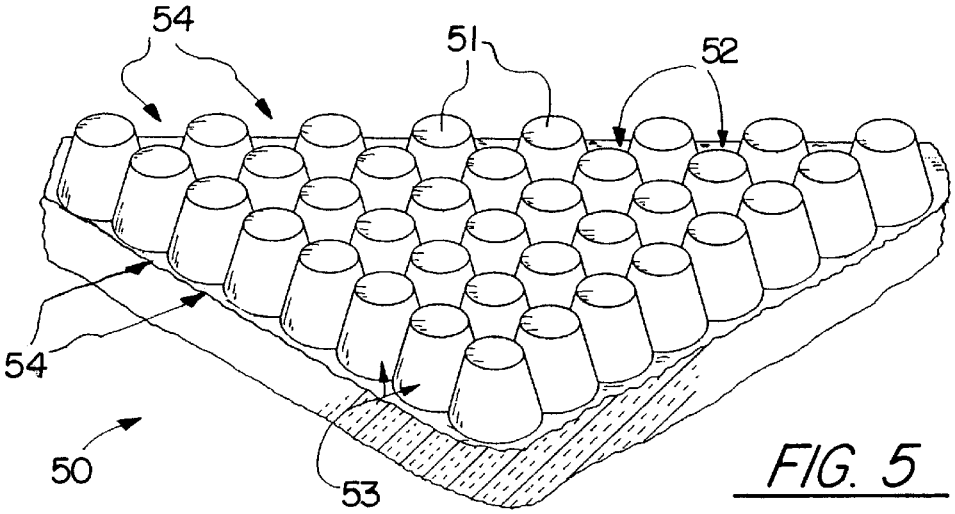

FIG. 5 Another embodiment with truncated cone-shaped studs.

The circular heater 1 shown in detail form in FIG. 1 has a dimensionally stable, one-piece insulating substrate in the form of a heat insulation moulding, which is manufactured from a microporous heat insulation material, which is either fibre-free or reinforced with physiologically unobjectionable fibres. The insulating substrate 2 is placed in a pot-shaped retaining plate 3, which forms a cooking area of a hob of a glass ceramic electric cooker. The high thermal insulating, temperature-resistant material of the insulating substrate has both good electrical insulation characteristics and good thermal insulation characteristics and preferably contains a silica obtained by flame pyrolysis. There is also an embodiment with multipart insulating substrates and it is in particular possible to provide a support, optionally made from a different material and which is placed below the structured insulating substrate. A top side 5 of the insulating substrate running substantially parallel to the planar bottom 4 of the insulating substrate, in the installed state of the heater, e.g. faces the bottom side of a glass ceramic plate. On the circumference of the insulating substrate projects axially an annular, through, insulating material edge or border 6, whose top side 7 parallel to the top side 5 of the insulator projects over the upper edge 8 of the vertical border of the retaining plate or support tray 3 and which, when the beater is installed, is e.g. pressed on the bottom side of a glass ceramic plate. The border 6, which in the embodiment shown is a separate heat insulation material moulding, but which in other embodiments can be constructed in one piece with the insulating substrate, on the one hand forms a spacer between the insulating substrate and the glass ceramic plate and on the other forms a thermally insulating, lateral boundary of an overall, roughly cup-shaped heating area.

As can in particular be gathered from FIG. 2, the top side 5 is uniformly structured in network-like or honeycomb manner. On its top side, the insulating substrate has a profiling with a network of raised portions 10 and cross-sectionally circular, in the drawing approximately cylindrical depressions 11, which form the network gaps of the network of raised portions 10. The depressions, which in practice widen slightly in conical manner towards the top side 5, e.g. with mould removal bevels of approximately 5 to approximately 35°, are arranged in parallel rows 12 with regular mutual spacings along the rows and are present in a surface distribution with six-fold rotational symmetry, which is characterized in that on rotating about a centre axis of a depression by 60°, the surface pattern of the depressions 11 and webs 10 passes into itself. The depressions 11 have essentially the same dimensions, with in the embodiment shown, a diameter of approximately 3 mm and a depth 14, measured between the surface 5 and the bottom 13 of a depression of also approximately 3 mm. In other embodiments the depressions can be smaller, e.g. with a diameter down to approximately 0.5 mm, or even larger, e.g. up to a maximum diameter of approximately 1 cm. Unlike in the embodiment shown, the depressions need not be circular in cross-section and can instead e.g. be triangular, quadrangular or hexagonal in the form of honeycombs or can have an irregular cross-sectional shape. Their depth can also be larger or smaller than their maximum diameter, but is preferably chosen in such a way that insulating material remains below the depressions. In the embodiment shown the depth 14 is approximately ¼ of the axial thickness of the insulating substrate 2.

In the embodiment shown, a lateral spacing 15 of the centroids or centres of adjacent depressions is approximately 1.3 times as large as the diameter of the depressions. Thus, between the depressions are left raised portions 10, which in the embodiment shown, through the roughly cylindrical shape of the axially oriented depressions, are substantially defined by side walls 16 perpendicular to the plane of the insulating substrate. As a result of the circular cross-sectional shape, the web-like, raised portions 10 have a variable width, which in the represented embodiment is min approximately 0.8 mm. The minimum width of the web-like raised portions can in particular be chosen in accordance with the mechanical strength of the thermal insulation material of the substrate, so that a web 10 is sufficiently mechanically stable. The raised portions 10 form a regular network of webs. Between in each case three adjacent depressions the network has junctions or intersections 17, where in each case three adjacent webs meet at angles of in each case 120°. Each depression not positioned at the edge of the insulating substrate is surrounded by six intersections of the network. The confined, uniform surface distribution of the intersections 17, like the distribution of the depressions, has a six-fold symmetry and the spacings of adjacent intersections roughly correspond to the diameter of the depressions.

As is particularly clearly visible in FIG. 1, to the insulating substrate 2 is fixed a longitudinally extending heating conductor 20 in the vicinity of the top side thereof in such a way that it is positively and/or non-positively secured against movements parallel to the insulating substrate 2 or to its longitudinal direction and against lifting out movements transversely to the insulating substrate. The heating conductor 20 constructed as an electric heating resistor is at least partly free within the cup space defined by the insulating substrate and the border and can be arranged roughly parallel to said border 6 in telescoped, single or multiple spiral windings or spirals or in concentric arcs, interconnected by turns. One or more heating conductors are preferably substantially uniformly distributed over a heating area, which over the entire circumference is approximately connected to the inner circumference of the border 6 and extends almost to the raised centre 21 of the insulating substrate.

Over its entire length, each heating resistor 20 has throughout a substantially constant, rectangular cross-section with parallel wide sides 22 and parallel narrow sides 23. The wide sides 22 are oriented substantially perpendicular to the insulating substrate, so that a heating conductor 20 can also be called an upright flat strip. The flat strip is made from a Fe-Cr-Al alloy and is approximately sinusoidally corrugated in uniform manner in its longitudinal direction. Half the corrugation length of the corrugation differs from the periodicity of the depressions and in the represented embodiment is approximately 10% smaller than the lateral spacing 15 of the centres of adjacent depressions. The thickness 24 of the meander-like corrugated flat strip measured between the wide sides 22 is approximately 0.05 mm and its average width 25 approximately 3 mm. A strip end of the heating conductor 20 can directly, without additional intermediate members, constructed as an electric connection end 26, 27 and brought into a position with respect to the remaining heating resistor 20 by bending or twisting, where it is particularly suitable for electrical connection purposes.

Following the manufacture of the insulating substrate 2, the heating conductors 20 are pressed into the honeycomb or network-like structured surface 5 thereof up to approximately half the band width 25 in the network structure of the raised portions. The insulating substrate material is only so fibre-reinforced that on pressing in the heating conductor readily cuts into the raised portions. Through the local separation or cutting of the fibre union or by the "barb action" of the fibre ends oriented in the slide-in direction, the heating conductor is well anchored. The honeycomb walls or network portions formed by the raised portions 10 and which separate from one another the depressions 1 forming the honeycomb cells or network gaps, are separated in part on pressing in, so that the broken-like shown fixing portions 28 of a heating conductor 20 engage positively in the material of the raised portions 10 and are fixed there substantially by friction against lifting out and longitudinal displacement. With a corresponding adaptation of the distribution of the raised portions to the dimensions and shape of the heating conductor, in this way it is possible to create a plurality of relatively closely juxtaposed, small area fixing points or surfaces for the heating conductor. The surface area of the fixing portions is appropriately chosen in such a way as to on the one hand ensure an adequate mechanical fixing of the heating conductor to the insulating substrate and on the other to ensure a minimum radiation surface of the heating conductor in the vicinity of the fixing portions. As stated, the raised portions should still have a thickness ensuring the necessary mechanical strength. The network structure of continuously interconnected honeycomb walls or webs formed by the raised portions 10 or honeycomb walls can provide an adequate number of relatively closely juxtaposed fixing points, without the positive fixing of the heating conductor covering significant areas of the heat-emitting strip surface of the heating conductor. A heating conductor can also have a different configuration relative to the insulating substrate. In all cases the insulating substrate provides an adequate number of adequately juxtaposed fixing points.

In the embodiment shown, per full corrugation of the heating conductor 20 there are on average roughly two fixing points or intersection areas with the webs 10. Preferably the spacing of adjacent fixing points of a heating conductor can be of the order of magnitude of the width or height of the heating conductor, e.g. between 1 and 5 mm, particularly approximately 3 mm. The surface extension of an individual intersection point or area need not be very large in order to ensure an adequate fixing stability. The average surface extension of the fixing areas can in particular be less than 2 $mm^2$ or less than 1 $mm^2$, which ensures that even in the case of a high fixing point density most of the heating conductor surface is exposed.

In the case of the preferably used heating conductors with positive temperature coefficient of the electrical resistor, advantageously there is a certain automatic regulation of the temperature differences in the areas of the fixing portions 28, because current flows somewhat more strongly through them if they are somewhat colder than the exposed portions and vice versa. The fitting of the heating conductor to the network-like structured surface can lead to the temperature being rendered more uniform along the heating conductor, which leads to an improved surface life. In the case of repeated heating and cooling of the heating conductor, no harmful loosening of said conductor from its positive retention was observed. Clearly the relatively narrow webs, on which the fixing portions 28 are formed, are sufficiently mobile in order to absorb the small movements of the heating conductor relative to the insulating substrate in the case of temperature changes resulting from the thermal expansion differences of the materials used.

In the vicinity of the depressions, the heating conductor pressed into the insulating substrate by only half its width 25 is kept at an internal spacing 29 above the bottom 13 of the depressions and so-to-speak is freely suspended without contact with the insulating substrate. The freely suspended areas within the depressions can adapt to temperature changes by increasing or decreasing their curvature without harmful stresses arising. It is also pointed out that the fixing portions 28 located within the insulating material have only a very small surface area compared with the exposed heating conductor surface areas directly contributing to the heating capacity. Most of the relatively narrow webs are separated along the surfaces of cut, whose impact angles with respect to the lateral faces defining the raised portion differs only slightly from 90°, e.g. by between 0 and 30°. Due to the comparatively limited engagement surface of the heating conductor in the insulating substrate, the electrical efficiency, the ratio of the electric power introduced to the thermal power directly usable for heating, is relatively high compared with the heating conductors embedded in larger surface manner. The penetration depth of the heating conductor in the insulating substrate material should be kept as small as possible, so that in the case of an adequate mechanical retention, large surface areas of the heating conductor are kept uncovered.

In the case of the insulator 30 of the embodiment shown in FIG. 3, in place of the substantially cylindrical or conical, slightly upwardly widened depressions 11, there are hemispherical depressions 31, whose diameter roughly corresponds to the strip width of the upright, corrugated heating conductor 32. The spacing distribution of the depressions and their depth and cross-sectional dimensioning compared with the heating conductor can correspond to the values for embodiment of FIGS. 1 and 2. As a result of the hemispherical shape, the raised portion 33 located between the depressions and forming a cohesive network has a downwardly widening base and can consequently be more mechanically stable than the webs of the embodiment of FIGS. 1 and 2. The geometry with rounded, particularly hemispherical depressions, following the moulding of the insulator, can particularly readily be removed from the mould and as a result of the larger contact surfaces in the intersection or cutting area for the same heating conductor penetration depth compared with the embodiment of FIG. 1 brings about an even more secure hold of the heating conductor in the insulator.

In the embodiment shown in FIG. 4 the insulator 40 has a complimentary structure to the surface of the insulator 30, in which the raised portions are in the form of spherical studs 41, which are uniformly distributed over the otherwise planar surface 42. In this embodiment between the studs arranged with a lateral spacing there is a cohesive network of depressions 44, which meet at the intersections and whose base or bottom is formed by the planar surface portions 42 of the insulator. The corrugated semiconductor flat strip 45 is pressed into the studs by roughly ⅔ of the radius thereof, so that the heating conductor is freely suspended over the planar surface 42 between the studs, in the vicinity of the depressions. Such studded surface structures can be manufactured substantially free from waste in the presently preferred dry pressing method, because they can be readily removed from the mould.

The diagrammatic representation of FIG. 5 shows in detail form the surface of an insulator 50 in another embodiment. The raised portions are in the form of truncated cone-shaped studs 51 which, unlike the studs 41 according to FIG. 4, abut with one another in the vicinity of their base 53 adjacent to the otherwise planar surface 52 of the insulator. With this four-fold, rotationally symmetrical stud arrangement, the network of depressions 54 is substantially formed by perpendicularly directed, V-shaped valleys, which are perpendicular to one another at the intersections. With a cone angle of approximately 40° and a stud height of roughly the flat strip width, compared with the embodiment of FIG. 4, there is a greater surface density of the fixing points for the heating conductor to be pressed into the planar surface area of the studs 51.

In the embodiments according to FIGS. 3 to 5, whose insulators can be made from the same material as that of FIGS. 1 and 2, the depressions are in the form of a cohesive network, whereas in the network gaps are located the raised portions serving to anchor the heating conductor.

The exemplified embodiments make it clear that the invention gives rise to universally usable insulators which , particularly due to their network-like surface structuring, are suitable for the press-in fixing of heating conductors, particularly perpendicular, upright heating conductor strips.

What is claimed is:

1. A heater, comprising:

an insulating substrate having a top side with a profile, the profile having raised portions and depressions distributed in a network over the top side of the insulating substrate, at least one of the raised portions and the depressions intersecting in non-linear directions; and at least one electric heating conductor fixed to the top side and engaging the raised portions such that a fixation of the heating conductor to the substrate is brought about at a plurality of fixing points arranged in specific intervals alone the heating conductor exclusively by the engagement between the heating conductor and the raised portions.

2. The heater according to claim 1, wherein the network is formed by the raised portions running in different directions along the top side and meeting at intersections.

3. The heater according to claim 1, wherein the network is formed by depressions running in different directions along the top side and meeting at intersections.

4. The heater according to claim 3, wherein raised portions in the form of studs are formed between the depressions.

5. The heater according to claim 4, wherein the studs are one of truncated, cone-shaped, and hemispherical.

6. The heater according to claim 1, wherein the at least one heating conductor has in a longitudinal direction a substantially constant cross-section, the heating conductor formed as a flat strip corrugated in the longitudinal direction and having parallel wide sides and through, parallel narrow sides, the wide sides being oriented substantially perpendicular to the insulating substrate.

7. The heater according to claim 6, wherein the heating conductor has a thickness between 0.02 and 0.1 mm.

8. The heater according to claim 7, wherein the heating conductor has a thickness between 0.04 and 0.08 mm.

9. The heater according to claim 6, wherein the heating conductor has a width between approximately 1 mm and approximately 5 mm.

10. The heater according to claim 1, wherein the ratio of the mass of the heating conductor to its rated capacity is lower than $7\times10^{-3}$ gram/watt.

11. The heater according to claim 1, wherein the heating conductor is made from an iron-chromium-aluminum alloy with an aluminum proportion of more than 4%.

12. The heater according to claim 1, wherein the heating conductor exclusively engages in raised portions.

13. The heater according to claim 1, wherein an internal spacing exists between a bottom of a depression and the heating conductor adjacent the depression.

14. The heater according to claim 1, wherein the depressions are laterally defined substantially by lateral faces running steeply to a plane of the insulating substrate.

15. The heater according to claim 1, wherein the depressions widen slightly towards the heating conductor.

16. The heater according to claim 1, wherein the depressions have at least one of a central-symmetrical cross-section and an angle-free cross-section.

17. The heater according to claim 1, wherein at least one of the depressions and the raised portions are of similar dimensions and are distributed across the top side in a uniform surface distribution.

18. The heater according to claim 17, wherein the surface distribution has one of a three-fold symmetry, a four-fold symmetry and a six-fold rotational symmetry.

19. The heater according to claim 1, wherein the raised portions have a cross-section which is at least one of central-symmetrical and angle-free.

20. The heater according to claim 1, wherein the depressions define centroids laterally spaced from each other and wherein a lateral spacing of centroids of adjacent depressions is between 1.1 and 2 times as large as a maximum diameter of a depression.

21. The heater according to claim 1, wherein the ratio between a depth of a depression and an average height of a heating conductor is between 0.2 and 3.

22. The heater according to claim 1, wherein the depth of a depression is smaller than the depth of an insulating substrate insulator in which the depression is formed.

23. The heater according to claim 1, wherein over its entire height the heating conductor engages in the raised portions.

24. The heater according to claim 1, wherein the heating conductor projects over the top side of the raised portions.

25. The heater according to claim 1, wherein the heater is adapted for use in a kitchen appliance.

26. The heater according to claim 1, wherein the heater is constructed as a radiant heater.

27. An insulating substrate for a heater, comprising:

a top side having a profile, the profile having raised portions and depressions being distributed in a network over the top side, at least one of the raised portions and the depressions intersecting in non-linear directions.

28. A heater, comprising:

an insulating substrate having a top side with a profile, the profile having raised portions and depressions distributed in a network over the top side of the insulating substrate, at least one of the raised portions and the depressions intersecting in non-linear directions;

at least one electric heating conductor fixed to the top side and engaging the raised portions such that a fixation of the heating conductor to the substrate is brought about by the engagement between the heating conductor and the raised portions;

wherein the network is formed by the depressions running in different directions along the top side and meeting at intersections; and wherein raised portions in the form of studs are formed between the depressions.

29. The heater according to claim 28, wherein the studs are one of truncated, cone-shaped, and hemispherical.

* * * * *

UNITED STATES PATENT AND TRADEMARK OFFICE

CERTIFICATE OF CORRECTION

PATENT NO. : 6,184,502 B1
DATED : February 6, 2001
INVENTOR(S) : Joachim Haazendonk It is certified that error appears in the above-identified patent and that said Letters Patent is hereby corrected as shown below:

Column 5,
Line 67, after the word "the" delete the word "beater" and insert -- heater --.

Column 11,
Line 20, after the word "directions", insert -- , at least one electric heating conductor fixed to the top side and engaging the raised portions such that a fixation of the heating conductor to the substrate is brought about at a plurality of fixing points arranged in specific intervals along the heating conductor exclusively by the engagement between the heating conductor and the raised portions --, Signed and Sealed this Twenty-sixth Day of March, 2002

*Attest:*

*Attesting Officer*

JAMES E. ROGAN
*Director of the United States Patent and Trademark Office*